US007284840B2

(12) United States Patent
Hibi

(10) Patent No.: US 7,284,840 B2
(45) Date of Patent: Oct. 23, 2007

(54) INKJET HEAD WITH COMMUNICATING FLOW PATHS

(75) Inventor: Manabu Hibi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 340 days.

(21) Appl. No.: 11/067,632

(22) Filed: Feb. 28, 2005

(65) Prior Publication Data

US 2005/0190238 A1 Sep. 1, 2005

(30) Foreign Application Priority Data

Feb. 27, 2004 (JP) ..... 2004-053411

(51) Int. Cl.
*B41J 2/045* (2006.01)

(52) U.S. Cl. ..... 347/68; 347/70; 347/71

(58) Field of Classification Search ..... 347/20, 347/56, 65, 67–68, 70, 71
See application file for complete search history.

(56) References Cited

U.S. PATENT DOCUMENTS 5,406,318 A * 4/1995 Moore et al. ..... 347/70

FOREIGN PATENT DOCUMENTS

JP A 2003-237078 8/2003

* cited by examiner

*Primary Examiner*—Juanita D. Stephens
(74) *Attorney, Agent, or Firm*—Oliff & Berridge, PLC.

(57) ABSTRACT

An ink flow path is formed inside an inkjet head so that ink supplied from openings is supplied to a manifold flow path via communication holes and so that the ink passes through pressure chambers from the manifold flow path and is discharged from nozzles. The manifold flow path includes plural intersecting regions formed by two types of sub-manifolds intersecting. The sub-manifolds are communicated at the intersecting regions.

13 Claims, 9 Drawing Sheets

INKJET HEAD WITH COMMUNICATING FLOW PATHS

BACKGROUND OF THE INVENTION

1. Field of the Invention

The present invention relates to an inkjet head that prints by discharging ink onto a recording medium.

2. Description of the Related Art

In JP-A-2003-237078, an inkjet head is described in which ink is distributed from a manifold to plural pressure chambers arranged in a matrix in a plane. In this inkjet head, plural actuator units that cause the capacities of the pressure chambers to change are attached to a flow path unit in which the manifold and nozzles are formed. When pressure is applied by the actuator units to the ink in an optional pressure chamber selected from the plural pressure chambers, the ink is discharged from the nozzle connected to that pressure chamber.

SUMMARY OF THE INVENTION

However, in the inkjet head described in JP-A-2003-237078, the ink is supplied to the pressure chambers from plural sub-manifolds branching from the manifold. These sub-manifolds are mutually independent and are communicated with each other at front end portions or intermediate sites. For this reason, when the discharge of the ink from the nozzles is stopped, pressure waves in the opposite direction from the discharge direction, which arise as a result of the flow of ink in the discharge direction being suddenly stopped, propagate to the ink inside the sub-manifolds and the pressure inside the sub-manifolds becomes uneven. Moreover, the pressure waves do not become attenuated in a short period of time inside the sub-manifolds. In other words, because the sub-manifolds are virtually not mutually communicated, it is difficult for the pressure waves propagating to the ink inside the sub-manifolds to become attenuated, and the state where the pressure inside the sub-manifolds is uneven continues for a long period of time. If the ink is discharged from the nozzles in this state, the difference in the uneven pressure inside the sub-manifolds appears as a difference in the ink discharge speeds, which leads to a deterioration in image quality.

It is an object of the present invention to provide an inkjet head that can make uniform the speed at which the ink is discharged from the nozzles.

According to one aspect of the invention, there is provided with an inkjet head including: a plurality of nozzles; a manifold flow path filled with ink to be discharged from the nozzles; an ink flow inlet path that supplies ink from outside through an ink supply port to the manifold flow path; and a plurality of individual ink flow paths that lead from an outlet of the manifold flow path through a pressure chamber to the nozzles, wherein the manifold flow path includes a plurality of unit flow paths extending, wherein both ends of each unit flow path communicates with the ink flow inlet path, wherein the unit flow paths ink flow inflow path intersect, and wherein the unit flow paths are communicated with each other at an intersecting region.

By thus configuration, since the plural unit flow paths configuring the manifold flow path are communicated with each other at the intersecting regions, the manifold flow path can easily cause pressure waves to be propagated to many unit flow paths. For this reason, pressure waves propagating from the pressure chambers to one unit flow path are successively propagated to unit flow paths other than that unit flow path, and the pressure waves rapidly become attenuated. Thus, the pressure waves propagating through the manifold flow path exert virtually no adverse affect on the discharging of the ink from the nozzles, and differences in the speeds at which the ink is discharged from the nozzles are reduced.

According to another aspect of the invention, the plural pressure chambers may be arranged along a predetermined plane, and for the outlets of the manifold flow path to be disposed at positions coinciding with the intersecting regions when seen from a direction orthogonal to the plane. By thus configuration, because the individual ink flow paths are communicated with each other at the intersecting regions where the propagation to the unit flow paths is excellent, the pressure waves effectively become attenuated and eliminated.

According to another aspect of the invention, the plural unit flow paths have plural first unit flow paths that extend in a first direction and plural second unit flow paths that extend in a second direction intersecting the first direction. By thus configuration, the manifold flow path including the intersecting regions can be easily configured by the first and second unit flow paths.

According to another aspect of the invention, the first unit flow paths may intersect the second unit flow paths at at least two places when viewed from the direction orthogonal to the plane. Thus, the first unit flow paths of the manifold flow path include at least two intersecting regions. For this reason, the pressure waves become effectively attenuated.

According to another aspect of the invention, the plural pressure chambers may be disposed so that their positional relationships with the plural intersecting regions are the same when viewed from the direction orthogonal to the plane. In this case, centers of the pressure chambers may coincide with centers of the intersecting regions when seen from the direction orthogonal to the plane. By thus configuration, because the positional relationships between the pressure chambers and the manifold flow path are the same, the difference in the compliances (inverse of rigidity) of the pressure chambers resulting from a difference in their positional relationships is controlled, and it becomes possible to make uniform the speeds at which the ink is discharged from the nozzles.

According to another aspect of the invention, plural types of plates including holes for forming at least one of the ink flow inlet path, the manifold flow path and the individual ink flow paths to be laminated so that holes in the plates are communicated with each other to form the flow paths, and for the plural types of plates to include a first manifold plate in which the plural first unit flow paths are formed and a second manifold plate in which the plural second unit flow paths are formed. Thus, the manifold flow path including the intersecting regions can be easily configured by two plates.

According to another aspect of the invention, end portions of the first unit flow paths and the second unit flow paths may be communicated with each other. By thus configuration, the ink flow into the second unit flow paths via the end portions of the first unit flow paths from the ink flow inlet paths. For this reason, it becomes easy for the ink to also be supplied to the second unit flow paths. When the positions where the end portions of the first and second unit flow paths are communicated with each other and the positions where the first unit flow paths and the ink flow inlet paths are communicated with each other coincide, it becomes easy to conduct ink supply across the entire manifold flow path.

DESCRIPTION OF THE PREFERRED EMBODIMENTS

A preferred embodiment of the invention will be described below with reference to the drawings.

Figure 1:
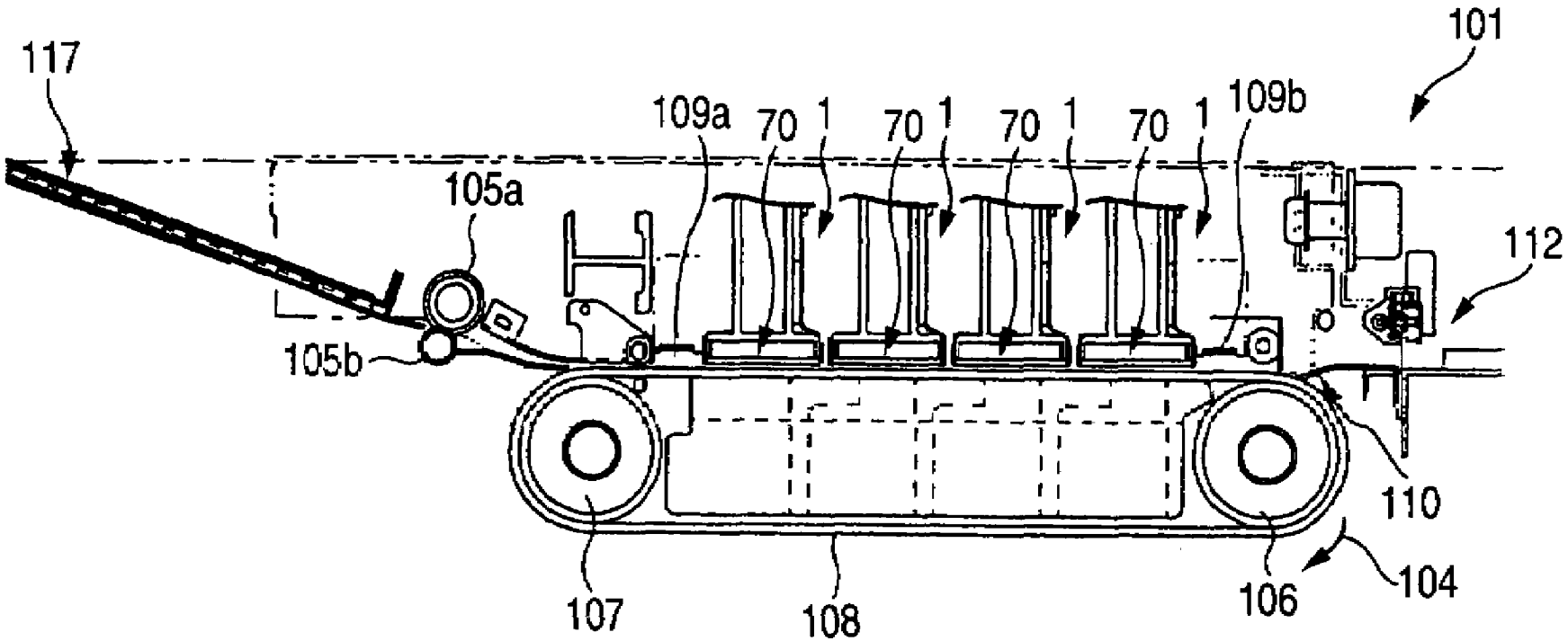
FIG. 1 is a schematic configural diagram of an inkjet printer to which an inkjet head according to an embodiment of the invention has been applied.

FIG. 1 is a schematic configural diagram of an inkjet printer 101 to which an inkjet head 1 according to an embodiment of the invention has been applied. As shown in FIG. 1, the inkjet printer 101 is a color inkjet printer including four of the inkjet heads 1. A paper supply unit 111 is disposed at the left side of the inkjet printer 101 in the drawing, and a paper discharge unit 112 is disposed at the right side of the inkjet printer 101 in the drawing.

A paper conveyance path, on which paper is conveyed from the paper supply unit 111 to the paper discharge unit 112, is formed inside the inkjet printer 101. A pair of feed rollers 105*a* and 105*b* that nip and convey the paper, which is an image recording medium, are disposed immediately downstream of the paper supply unit 111. The paper is sent from left to right in the drawing by the pair of feed rollers 105*a* and 105*b*. Two belt rollers 106 and 107, and an endless conveyor belt 108 that is wound around the belt rollers 106 and 107 so as to span the distance between the belt rollers 106 and 107, are disposed at an intermediate portion of the paper conveyance path. Silicone is administered to the outer peripheral surface (i.e., the conveyance surface) of the conveyor belt 108. The paper conveyed by the pair of feed rollers 105*a* and 105*b* is retained on the conveyance surface of the conveyor belt 108 by the adhesive force thereof, and the belt roller 106 is rotatingly driven in the clockwise direction in the drawing (i.e., in the direction of arrow 104), whereby the paper is conveyed downstream (rightward).

Each of the four inkjet heads 1 includes a head body 70 at a lower end. Each of the head bodies 70 has a rectangular cross-section, and the head bodies 70 are arranged in mutual proximity so that their longitudinal directions are perpendicular to the paper conveyance direction (i.e., so that their longitudinal directions are perpendicular to the surface of the page of FIG. 1). In other words, the printer 101 is a line printer. Bottom surfaces of the four head bodies 70 face the paper conveyance path, and numerous nozzles 8 that have minute diameters are disposed on these bottom surfaces. Magenta, yellow, cyan and black inks are respectively discharged from the four head bodies 70 (see FIGS. 6A and 6B).

The head bodies 70 are disposed so that a tiny gap is formed between the undersurfaces of the head bodies 70 and the conveyance surface of the conveyor belt 108. The paper conveyance path is formed in this gap portion. With this configuration, when the paper conveyed on the conveyor belt 108 successively passes just below the four head bodies 70, the color inks are discharged from the nozzles towards the upper surface (i.e., the printing surface) of the paper, whereby a desired color image is formed on the paper.

Figure 2:
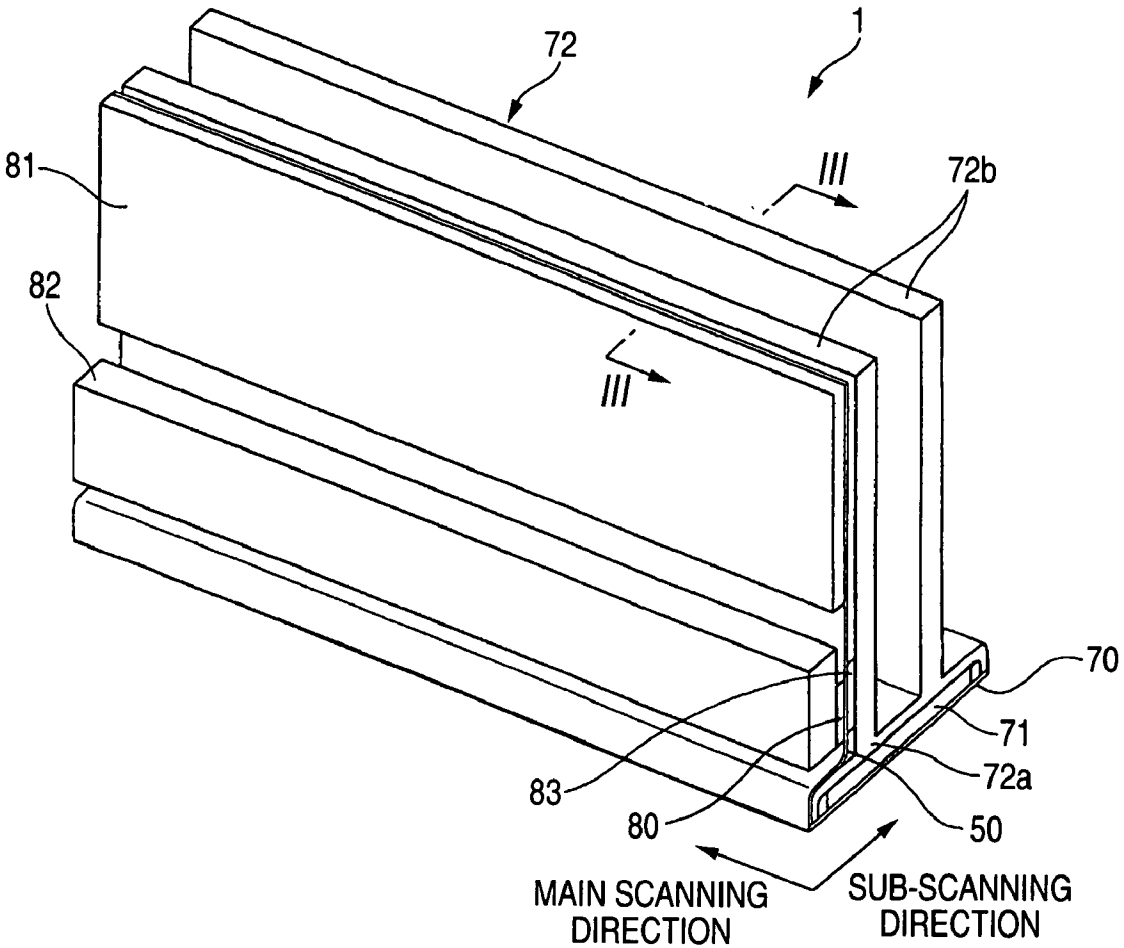
FIG. 2 is an external perspective diagram of the inkjet head according to the embodiment of the invention.
Figure 3:
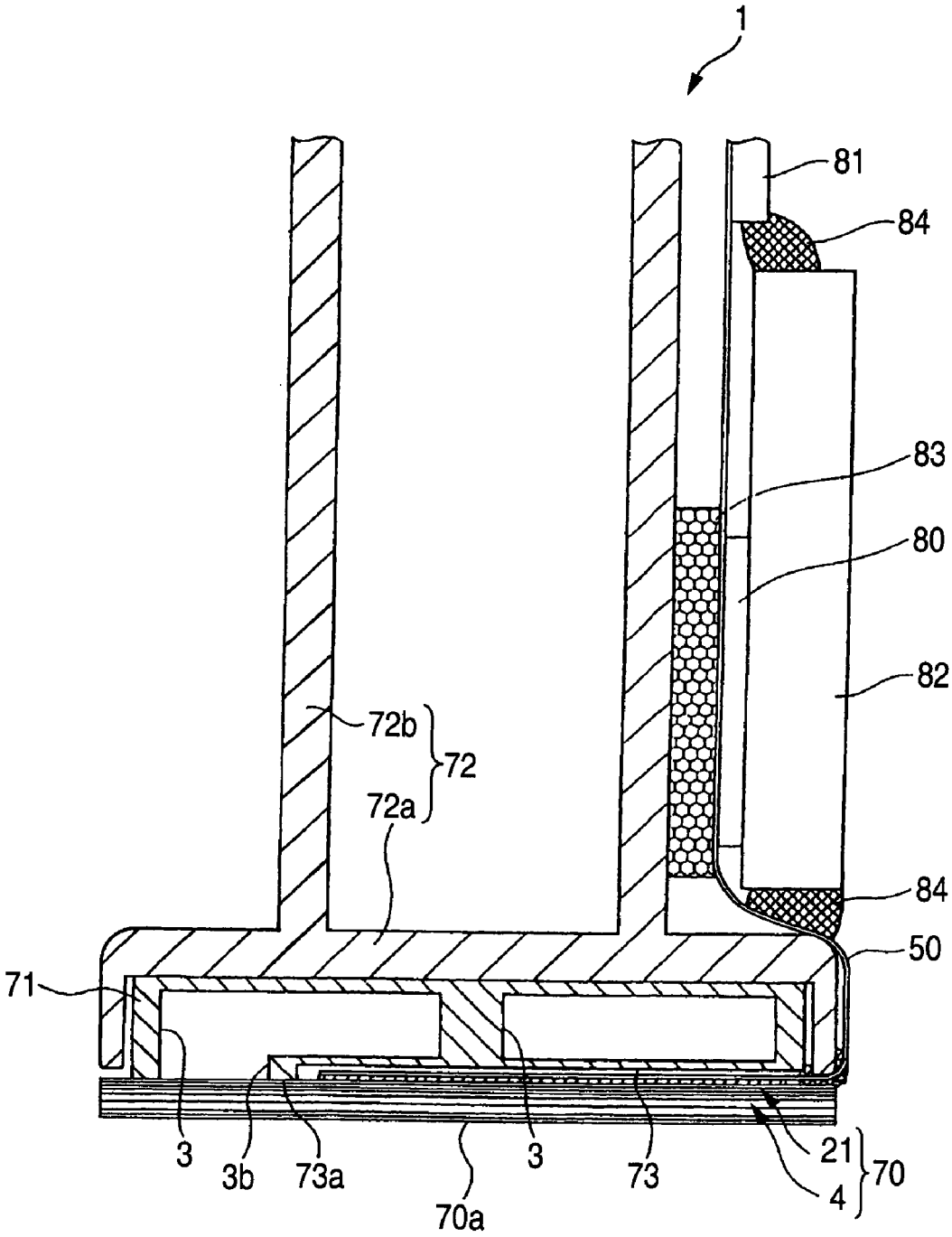
FIG. 3 is a cross-sectional diagram along line III-III of FIG. 2.

Next, the inkjet head 1 will be described in detail. FIG. 2 is an external perspective view of the inkjet head 1 pertaining to the embodiment of the invention. FIG. 3 is a cross-sectional diagram along line III-III of FIG. 2. As shown in FIG. 2, the inkjet head 1 is disposed with the head body 70, which has a rectangular cross-sectional shape that extends in a main scanning direction for discharging the ink with respect to the paper, and a base block 71, which is disposed above the head body 70 and in which are formed two ink reservoirs 3 that are flow paths of the ink supplied to the head body 70.

The head body 70 includes a flow path unit 4, in which ink flow paths are formed, and plural actuator units 21, which are adhered to an upper surface of the flow path unit 4 with an epoxy thermosetting adhesive. The flow path unit 4 comprises plural thin plates that are laminated and adhered to each other. The bottom surface of the head body 70 serves as an ink discharge surface 70*a* in which the plural nozzles 8 (see FIGS. 6A and 6B) that have tiny diameters are arranged. A flexible printed circuit (FPC) 50 that is a power feeding member is adhered to upper surfaces of the actuator units 21. The FPC 50 curves to the right side in FIG. 3 and is then led upward.

Figure 4:
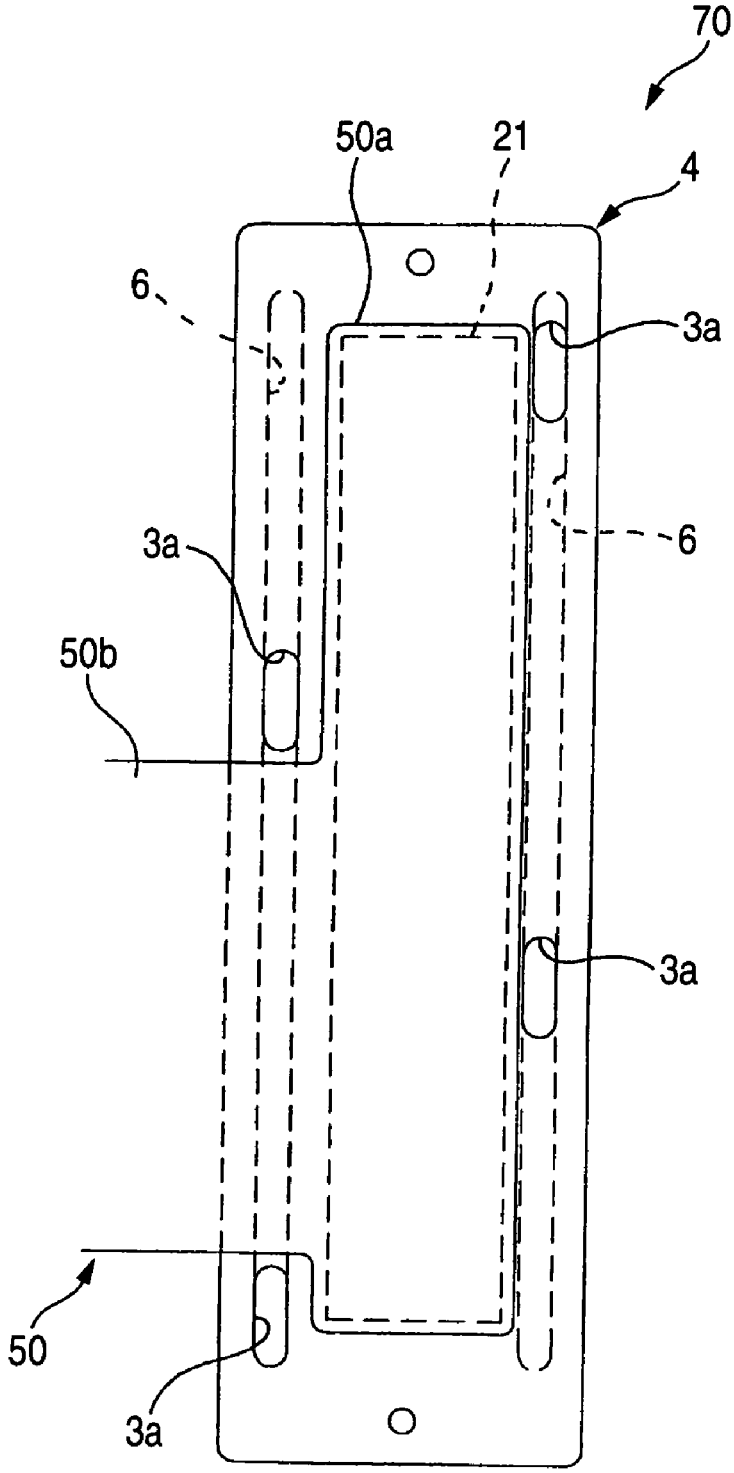
FIG. 4 is a plan diagram of a head body shown in FIG. 2.

FIG. 4 is a plan diagram of the head body 70. As shown in FIG. 4, the flow path unit 4 has a rectangular shape in plan view that extends in one direction (main scanning direction). As shown in FIG. 4, the actuator units 21, which are rectangular in plan view, are adhered to the upper surface of the flow path unit 4 so as to avoid four openings (ink supply ports) 3*a*. Two of the openings 3*a* are disposed at both width-direction end portions of the flow path unit 4 and are mutually separated along the longitudinal direction. Two communication holes 6 are formed that serve as ink flow inlet paths communicated with the four openings 3*a* are formed inside the flow path unit 4. A manifold flow path 5 (see FIG. 5) serving as a common ink chamber is also disposed inside the flow path unit 4. The communication holes 6 extend along the longitudinal direction of the flow path unit 4 and coincide with the openings 3*a* formed in the width-direction end portions of the flow path unit 4. Ink inside the manifold flow path 5 is supplied from the ink reservoirs 3 of the base block 71 via the four openings 3*a* and the two communication holes 6.

As shown in FIG. 4, the FPC 50 adhered to the upper surface of the actuator unit 21 includes a connection portion 50*a*, which is adhered to the actuator unit 21, and a pull-out portion 50*b*, which is pulled out to the left side of FIG. 4 from the connection portion 50*a*. The pull-out portion 50*b* is pulled out from the connection portion 50*a* so as to pass between the two openings 3*a* disposed at the left side of FIG. 4 along the longitudinal direction of the flow path unit 4.

The ink discharge surface 70*a*, which is the undersurface of the flow path unit 4 corresponding to the adhesion region of the actuator units 21, serves as an ink discharge region in which the numerous nozzles 8 (see FIGS. 6A and 6B) are arranged. A pressure chamber group 9 (see FIG. 5), in which the numerous pressure chambers 10 (see FIGS. 6A and 6B) are arranged, is formed on the upper surface of the flow path unit 4 corresponding to the actuator units 21. In other words, the actuator units 21 have a dimension spanning the numerous pressure chambers 10 configuring the pressure chamber group 9.

Returning to FIG. 3, the base block 71 comprises a metal material such as stainless steel. The ink reservoirs 3 inside the base block 71 are substantially rectangular hollow regions formed along the longitudinal direction of the base block 71. Ink is supplied to the ink reservoirs 3 from an ink tank (not shown) disposed on the outside via an ink introducing hole (not shown) disposed at one end of the ink reservoirs 3. A total of four openings 3*b* for flowing the ink are disposed in two rows in the ink reservoirs 3 along an extension direction of the openings 3*b*. The openings 3*b* are disposed in a staggered manner so as to be connected to the openings 3*a* of the flow path unit 4. Namely, the four openings 3*b* of the ink reservoirs 3 and the four openings 3*a* of the flow path unit 4 are disposed at the same positions.

An undersurface 73 of the base block 71 extends further downward than the periphery of the vicinity of the opening 3*b*. The base block 71 contacts a vicinity portion of the opening 3*a* at the upper surface of the flow path unit 4 only at an opening portion 3*a* vicinity portion 73*a* of the undersurface 73. For this reason, the region outside the opening 3*b* vicinity portion 73*a* of the undersurface 73 of the base block 71 is separate from the head body 70, and the actuator units 21 are disposed in this separation portion.

A holder 72 includes a gripping portion 72*a*, which grips the base block 71, and a pair of protruding portions 72*b*, which are disposed with an interval therebetween in a sub-scanning direction and protrude upward from the upper surface of the grip portion 72*a*. The base block 71 is adhered and fixed inside a concave portion formed in the undersurface of the gripping portion 72*a* of the holder 72. The FPC 50 adhered to the actuator units 21 is disposed along the surface of the protruding portion 72*b* of the holder 72 at the right side of the drawing via an elastic member 83 such as a sponge. A driver IC 80 is disposed on the FPC 50 disposed on the surface of the protruding portion 72*b* of the holder 72. Namely, the FPC 50 transmits a drive signal outputted from the driver IC 80 to the actuator units 21 of the head body 70, and is electrically bonded to the actuator units 21 and the driver IC 80 with solder.

Because a substantially rectangular heat sink 82 is closely adhered to and disposed on the outer surface of the driver IC 80, heat generated by the driver IC 80 can be efficiently dissipated. A substrate 81 connected to the outer side of the FPC 50 is disposed above the driver IC 80 and heat sink 82. The upper surface of the heat sink 82 and the substrate 81, and the undersurface of the beat sink 82 and the FPC 50, are adhered together with seal members 84 so that dirt and ink are prevented from penetrating the body of the inkjet head 1.

Figure 5:
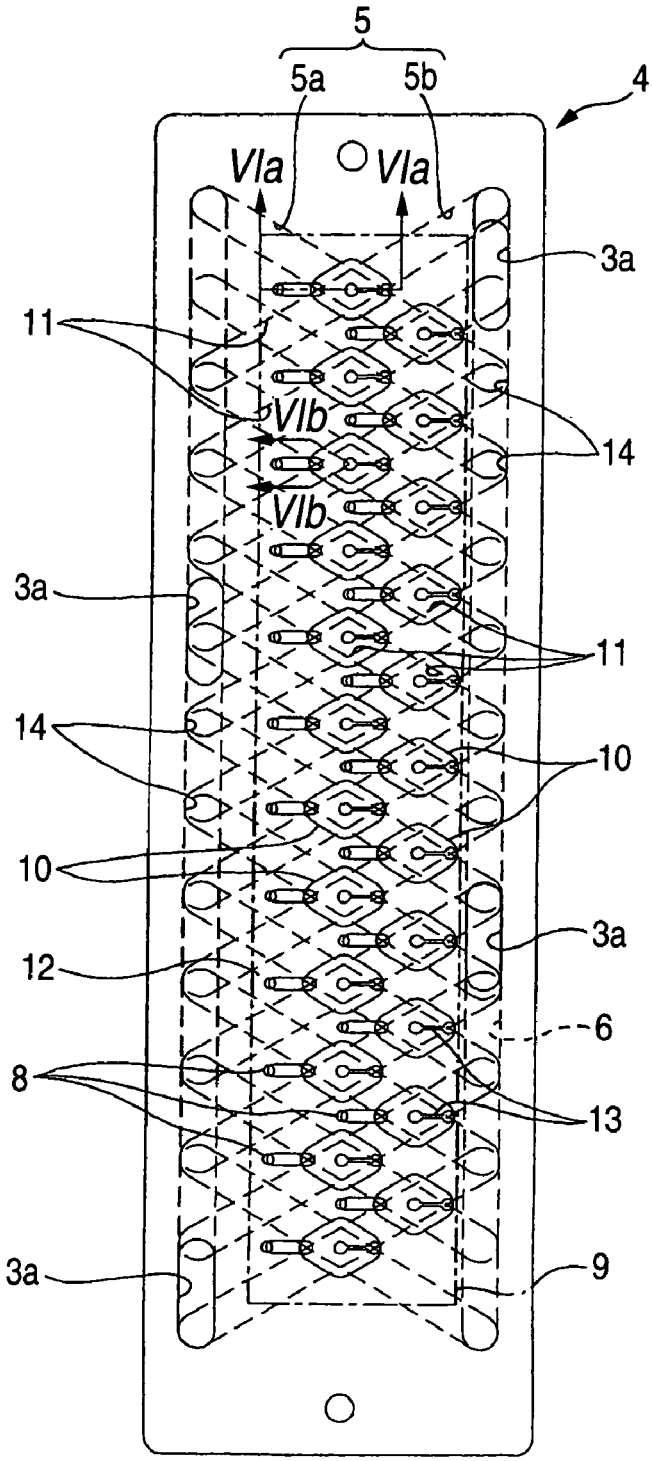
FIG. 5 is a plan diagram of a flow path unit shown in FIG. 3.

FIG. 5 is a plan diagram of the flow path unit 4. As shown in FIG. 5, the pressure chamber group 9 comprising the numerous pressure chambers 10 is formed within the adhesion range of the actuator units 21 on the upper surface of the flow path unit 4. The pressure chamber group 9 has a rectangular shape that is substantially the same size as the adhesion range of the actuator units 21 shown in FIG. 4. The manifold flow path 5 inside the flow path unit 4 includes plural sub-manifolds (first unit flow paths) 5*a* and plural sub-manifolds (second unit flow paths) 5*b*. The sub-manifolds 5*a* extend in a direction from the upper left to the lower right (first direction) in FIG. 5, which is a direction intersecting the longitudinal direction of the flow path unit 4, and are separately disposed along the longitudinal direction of the flow path unit 4. The sub-manifolds 5*b* extend in a direction from the upper right to the lower left (second direction) in FIG. 5, which is a direction intersecting the longitudinal direction of the flow path unit 4, and are separately disposed along the longitudinal direction of the flow path unit 4. The sub-manifolds 5*a* and 5*b* have the same plan shapes, and are disposed so that their centers mutually overlap and so that they are symmetrical in relation to a straight line joining their centers. As will be described later, the sub-manifolds 5*a* and 5*b* are disposed at different heights inside the flow path unit 4, with the height at the lowermost position of the sub-manifolds 5*a* corresponding to the height at the uppermost position of the sub-manifolds 5*b*.

Of the plural sub-manifolds 5*a* and 5*b*, the four sub-manifolds 5*a* and 5*b* positioned at both longitudinal-direction end portion sides of the flow path unit 4 (i.e., the two sub-manifolds 5*a* and 5*b* positioned at each longitudinal-direction end portion side of the flow path unit 4) include two intersecting regions 11 apiece where the sub-manifolds 5*a* and 5*b* intersect at places other than at both end portions. The other plural sub-manifolds 5*a* and 5*b* include three intersecting regions 11 apiece. In FIG. 5, the plural intersecting regions 11 are disposed in three rows in a staggered manner along the longitudinal direction of the flow path unit 4. These intersecting regions 11 are substantially diamond-shaped in plan view.

Also, of the plural sub-manifolds 5*a* and 5*b*, only one of each of the end portions of the eight sub-manifolds 5*a* and 5*b* positioned at both longitudinal-direction end sides of the flow path unit 4 (i.e., the four sub-manifolds 5*a* and 5*b* positioned at each longitudinal-direction end portion side of the flow path unit 4) overlaps with the end portions of the other sub-manifolds 5*a* and 5*b* in plan view. Both end portions of the rest of the plural sub-manifolds 5*a* and 5*b* overlap with the end portions of the other sub-manifolds 5*a* and 5*b* in plan view. The sub-manifolds 5*a* and 5*b* are communicated with each other in the vertical direction at the intersecting regions 11 and at regions 14 where the end portions of the sub-manifolds 5*a* and 5*b* overlap. Due to this configuration, it becomes possible for ink to be supplied via the communication holes 6 from the openings 3*a* to the sub-manifolds 5*a* and 5*b* configuring the manifold flow path 5, and the ink can also be made to flow alternately between the sub-manifolds 5*a* and 5*b*. Also, because the sub-manifolds 5*a* and 5*b* are communicated with each other at the regions 14, the ink is supplied immediately to the sub-manifolds 5*a* and 5*b* from the communication holes 6 serving as the ink flow inlet paths. In other words, if the regions 14 that communicate the end portions of the sub-manifolds 5*a* and 5*b* are not formed, the sub-manifolds 5*a* and 5*b* are communicated only at the intersecting regions 11, and it becomes difficult to supply the ink to the insides of the sub-manifolds 5*a*, but because the end portions of the sub-manifolds 5*a* and 5*b* are communicated at the regions 14 as in the present embodiment, the ink can be smoothly supplied to the sub-manifolds 5*b* also, and ink supply becomes easier across the entire manifold flow path 5.

Figure 6A:
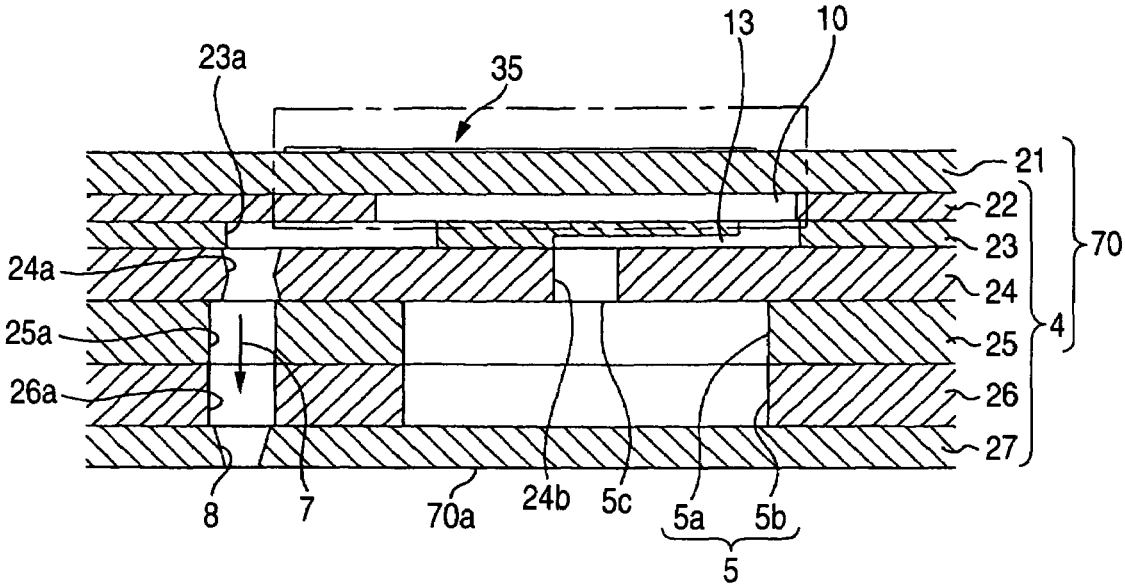
FIG. 6A is a cross-sectional diagram along line VIa-VIa of FIG. 5.
Figure 6B:
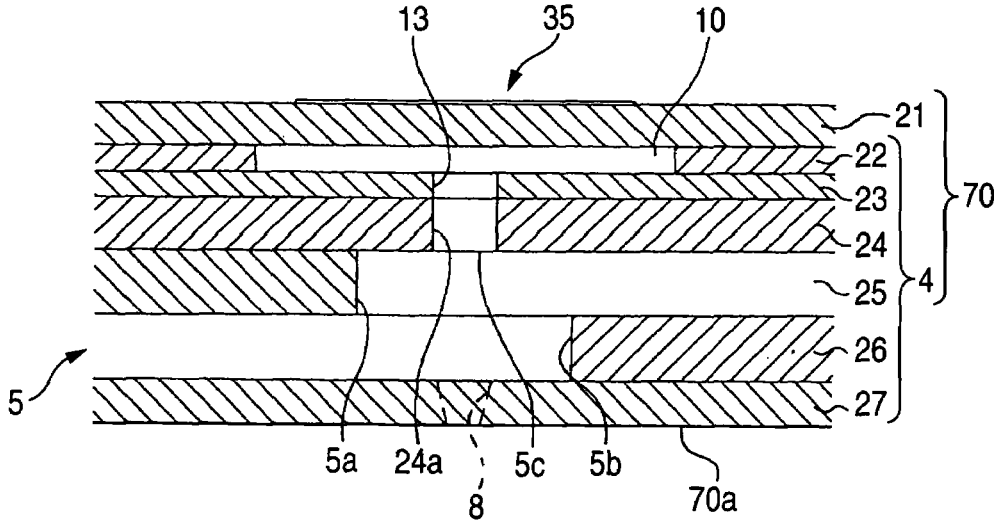
FIG. 6B is a cross-sectional diagram along line VIb-VIb of FIG. 5.

As shown in FIG. 5, of the three rows of intersecting regions formed by the plural intersecting regions 11, numerous individual ink flow paths 7 (see FIGS. 6A and 6B) that pass through to the nozzles 8 are connected to the intersecting regions 11 forming the two rows of intersecting regions at the right side and center of FIG. 5. FIGS. 6A and 6B show the flow path unit 4, with FIG. 6A being a cross-sectional diagram along line VIa-VIa of FIG. 5, and FIG. 6B being a cross-sectional diagram along line VIb-VIb of FIG. 5. As will be understood from FIGS. 6A and 6B, each nozzle 8 is communicated with the sub-manifolds 5*a* of the manifold flow path 5 via the pressure chambers 10 and apertures 13. In this manner, an individual flow path 7 leading from an outlet 5*c* of the manifold flow path 5 to the nozzle 8 via the aperture 13 and the pressure chamber 10 is formed for each pressure chamber 10 in the head body 70.

As shown in FIGS. 6A and 6B, the head body 70 has a laminate structure comprising a total of seven sheets: from the top, these are the actuator unit 21, a cavity plate 22, an aperture plate 23, a supply plate 24, a first manifold plate 25, a second manifold plate 26 and a nozzle plate 27. The flow path unit 4 is configured by the six plates excluding the actuator unit 21.

Figure 7A:
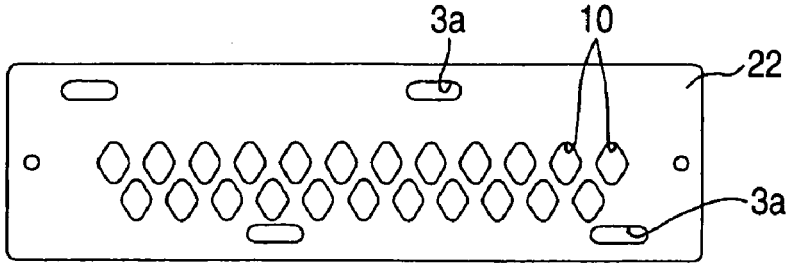
FIGS. 7A to 7F are plan diagrams of plates configuring the flow path unit shown in FIG. 3.
Figure 7B:
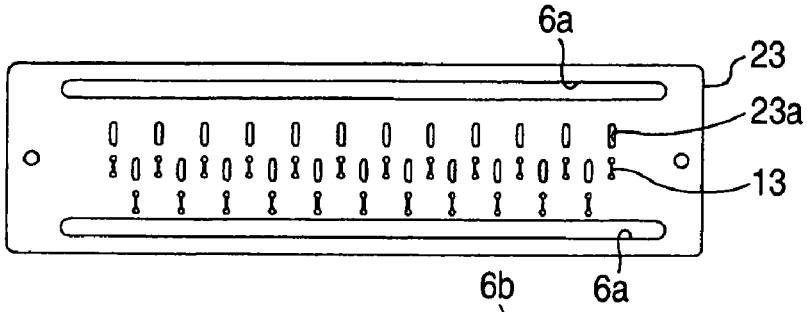
Figure 7C:
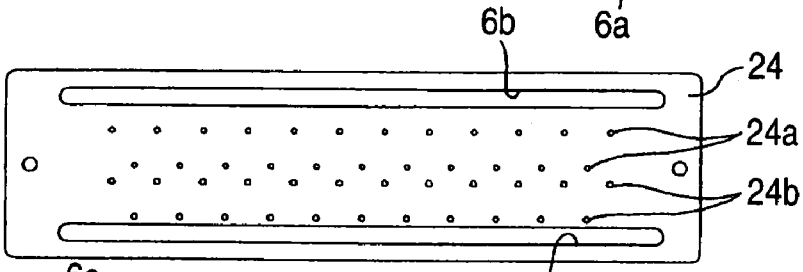

As will be described in detail later, the actuator unit 21 comprises a laminate of four piezoelectric sheets 41 to 44 disposed with an electrode (see FIG. 8A). Only the uppermost layer of these has a portion that becomes active when an electric field is applied (this layer will be referred to below simply as "the layer including the active portion"). The remaining three layers are inactive layers that do not include an active portion. As shown in FIGS. 7A to 7F, the plates 22 to 27 configuring the flow path unit 4 are rectangular in plan view and are of the same size. As shown in FIGS. 6A, 6B and 7A, the cavity plate 22 is a metal plate including substantially diamond-shaped holes, which are numerously disposed within the adhesion range of the actuator units 21 and configure the voids of the pressure chambers 10, and the four openings 3*a*. As shown in FIGS. 6A, 6B and 7B, the aperture plate 23 is a metal plate including holes 6*a*, which configure communication holes 6*a* that are communicated from the openings 3*a* to the manifold flow path 5, the apertures 13, which join two holes and the space therebetween in regard to one pressure chamber 10 of the cavity plate 22, and communication holes 23*a*, which are substantially rectangular in plan view and are communicated from the pressure chambers 10 to the nozzles 8. As shown in FIGS. 6A, 6B and 7C, the supply plate 24 is a metal plate including holes 6*b*, which configure communication holes 6 that are communicated from the openings 3*a* to the manifold flow path 5, communication holes 24*a*, which are communicated from the pressure chambers 10 to the nozzles 8 in regard to one pressure chamber 10 of the cavity plate 22, and communication holes 24*b*, which are communicated from the apertures 13 to the sub-manifolds 5*a*.

Figure 7D:
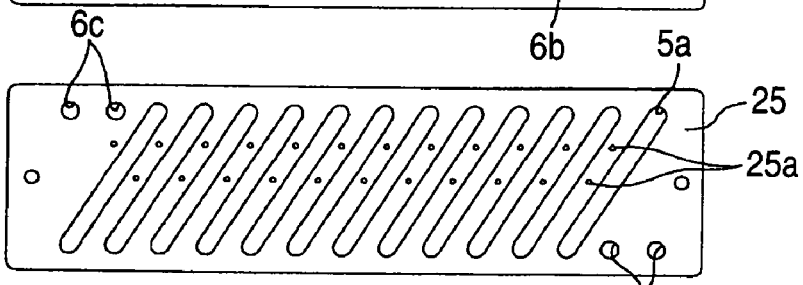
Figure 7E:
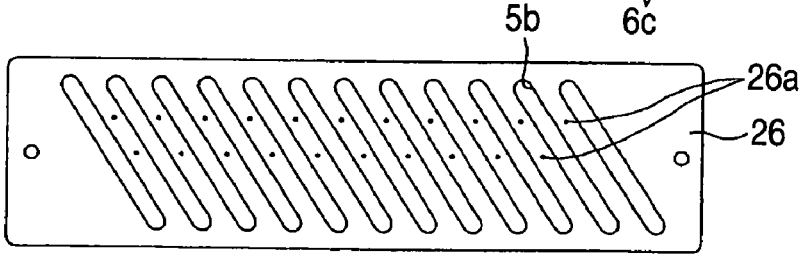
Figure 7F:
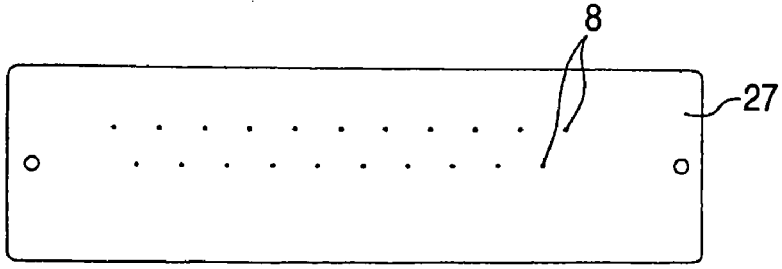

As shown in FIGS. 6A, 6B and 7D, the first manifold plate 25 is a metal plate including plural holes that extend in the direction from the upper right to the lower left (first direction) of FIG. 7D and serve as the sub-manifolds 5*a* separately disposed along the longitudinal direction of the flow path unit 4, communication holes 6*c* that are disposed so as to be point-symmetrical at the center point of the first manifold plate 25 and which are communicated with the communication holes 6 and the sub-manifolds 5*b*, and communication holes 25*a* that are communicated from the pressure chambers 10 to the nozzles 8 in regard to one pressure chamber 10 of the cavity plate 22. Because the communication holes 6*c* are formed in the first manifold plate 25, ink is supplied to the sub-manifolds 5*b* via the communication holes 6*c* from the communication holes 6. Namely, the end portions of all of the sub-manifolds 5*a* and 5*b* are communicated with the communication holes 6, and it becomes easier to conduct ink supply. As shown in FIGS. 6A, 6B and 7E, the second manifold plate 26 is a metal plate including plural holes, which extend in the direction from the upper left to the lower right (second direction) of FIG. 7E and serve as the sub-manifolds 5*b* separately disposed along the longitudinal direction of the flow path unit 4, and communication holes 26*a*, which are communicated from the pressure chambers 10 to the nozzles 8 in regard to one pressure chamber 10 of the cavity plate 22. As shown in FIGS. 6, 7E and 7E, when sub-manifolds 5*a*, 5*b* is regularly arranged in the longitudinal direction of the flow path unit 4, in view of the construction of the flow path unit 4, a regulation of the arrangement of the sub-manifolds contributes to an uniformity of whole rigidity of the flow path unit 4. If the whole rigidity is not uniform, a specific vibration will occur locally. Accordingly, an uniformity of discharge characteristic of the inkjet head is limited. However, by the-above regular arrangement of the manifolds 5*a*, 5*b*, the uniformity of the discharge characteristic can be utilized, even if alternative applications (e.g. modification of working frequency or modification of ink) are applied, a constructive modification of the inkjet head can be utilized. As shown in FIGS. 6A, 6B and 7F, the nozzle plate 27 is a metal plate disposed with a nozzle 8 in regard to one pressure chamber 10 of the cavity plate 22. As is apparent from the above description, the pressure chambers 10 are formed along the upper surface (the surface to which the actuator units 21 are adhered) of the flow path unit 4 configured by the six plates 22 to 27, and the pressure chambers 10 open at the upper surface.

These six metal plates are mutually aligned and laminated so that the individual ink paths 7 are formed, as shown in FIG. 6A. Each individual ink path 7 first bears upward from the outlet 5*c* of the manifold flow path 5, extends horizontally at the aperture 13, then bears upward, again extends horizontally at the pressure chamber 10, then bears downward, extends horizontally at the communication hole 23*a*, and then bears directly downward through the communication holes 24*a*, 25*a* and 26*a* to the nozzle 8. When the flow path unit 4 is seen in plan view, the nozzles 8 and descender flow paths comprising the communication holes 24*a*, 25*a* and 26*a* are formed in regions 12 (see FIG. 5) where neither of the sub-manifolds 5*a* and 5*b* are formed. Also, as shown in FIG. 6B, the sub-manifolds 5*a* and the sub-manifolds 5*b* are communicated with each other at the intersecting regions 11, and the manifold flow path 5 is communicated with the individual flow paths 7 at the centers of the intersecting regions 11 in FIG. 5. For this reason, even if pressure waves propagating from the pressure chambers 10 propagate to the intersecting regions 11 of the manifold flow path 5, the pressure waves soon propagate to many of the sub-manifolds 5*a* and 5*b* from the intersecting regions 11. Similarly, the pressure waves also soon propagate to many of the sub-manifolds 5*a* and 5*b* from the regions 14. Thus, the pressure waves propagating to the manifold flow path 5 become rapidly attenuated.

Also, as is apparent from FIGS. 6A and 6B, the first and second manifold plates 25 and 26 are joined together at the time of lamination and configure the manifold flow path 5. Because the sub-manifolds 5*a* and 5*b* configuring the manifold flow path 5 are formed in the different plates 25 and 26, the manifold flow path 5, which includes the intersecting regions 11 in which the sub-manifolds 5*a* and 5*b* mutually intersect at at least two places as shown in FIG. 5, can be easily configured. In the present embodiment, two plates are used to configure the manifold flow path 5, but the manifold flow path 5 may also be configured by a single plate in which the first and second manifold plates 25 and 26 are integrated. In other words, the manifold flow path 5 may be configured by a single plate where the sub-manifolds 5*a* are formed in one side of a thick plate by half etching and the sub-manifolds 5*b* are formed in the opposite side by half etching. Moreover, an additional plate that is the same as the first manifold plate may be disposed between the first manifold plate and the second manifold plate to increase the capacity of the sub-manifolds 5*a*. In this manner, the capacity or the manifold flow path 5 becomes larger, and it becomes easier for pressure waves propagating from the pressure chambers 10 to become attenuated.

As is apparent from FIG. 6A, the pressure chambers 10 and the apertures 13 are disposed at different levels in the lamination direction of the plates. Thus, as shown in FIG. 5, it becomes possible to dispose the aperture 13 communicating with one pressure chamber 10 at the same position, when seen in plan view, as the pressure chamber 10 inside the flow path unit 4 facing the actuator units 21. As a result, because the pressure chambers 10 are tightly arranged at a high density, high-resolution image printing is realized by the inkjet head 1 occupying a relatively small area.

As is apparent from FIG. 5, each pressure chamber 10 belonging to the pressure chamber group 9 communicates with the nozzle 8 at one end of a long diagonal line, and communicates with the sub-manifold flow paths 5*a* via the apertures 13 at the other end of the long diagonal line. As will be described later, an individual electrode 35 (see FIGS. 8A and 8B) that is diamond-shaped in plan view and is slightly smaller than the pressure chamber 10, is disposed facing the pressure chamber 10 on each actuator unit 21.

The plural pressure chambers 10 are disposed at positions facing the intersecting regions 11, in which the two types of sub-manifolds 5*a* and 5*b* intersect, belonging to the two rows of intersecting regions 11 excluding the row of intersecting regions 11 at the left side of FIG. 5, and are arranged in two rows in a staggered manner along the longitudinal direction of the flow path unit 4. In the present embodiment, the pressure chambers 10 are disposed so that their centers coincide with the centers of the intersecting regions 11, and the positional relationships between the pressure chambers 10 and the intersecting regions 11 are all the same in plan view. Due to this configuration, the positional relationships between the pressure chambers 10 and the manifold flow path 5 can all be made the same. When a common ink chamber (manifold flow path) extending along the longitudinal direction of the flow path unit is formed and nozzles are disposed to discharge ink in a perpendicular direction with respect to the surface in which the pressure chambers are disposed, as in Patent Document 1, all of the pressure chambers cannot be disposed so as to face the common ink chamber. Thus, two types of pressure chambers inevitably arise: those that face the common ink chamber and those that do not. Of these two types of pressure chambers, the compliances (inverse of rigidity) of the pressure chambers facing the common ink chamber at the time of the ink discharge operation are relatively large, but the compliances of the pressure chambers not facing the common ink chamber at the time of the ink discharge operation are relatively small. In other words, a difference in the compliances appears as a difference in the ink discharge speeds, which results in image quality deterioration; but in the present embodiment, because the positional relationships between the pressure chambers 10 and the manifold flow path 5 are all the same with respect to each pressure chamber 10, the difference in the compliances of the pressure chambers resulting from a difference in their positional relationships can be virtually eliminated. Thus, it becomes possible to make uniform the speed at which the ink is discharged from the nozzles 8.

As shown in FIG. 5, of the two rows of pressure chambers 10, the acute angle portions at the right sides of the pressure chambers 10 belonging to the pressure chamber row positioned at the left side of FIG. 5 are positioned between the pressure chambers 10 belonging to the pressure chamber row positioned at the right side of FIG. 5, and the acute angle portions at the left sides of the pressure chambers 10 belonging to the pressure chamber row positioned at the right side of FIG. 5 are positioned between the pressure chambers 10 belonging to the pressure chamber row positioned at the left side of FIG. 5. In the pressure chambers 10, in relation to the direction parallel to the short direction of the flow path unit 4, the nozzles 8 are unevenly distributed at the left side of FIG. 5 when seen from the direction perpendicular to the page, and disposed at positions that do not coincide with the sub-manifolds 5*a* and 5*b*.

Next, the detailed configuration of the actuator units 21, which are laminated on the cavity plate 22 that is the uppermost layer of the flow path unit 4, will be described. FIGS. 8A and 8B show the actuator unit 21, with FIG. 8A being an enlarged diagram of the part enclosed by the one-dot chain line shown in FIG. 6A, and FIG. 8B being an enlarged plan diagram showing part of the upper surface of the actuator unit 21.

Figure 8A:
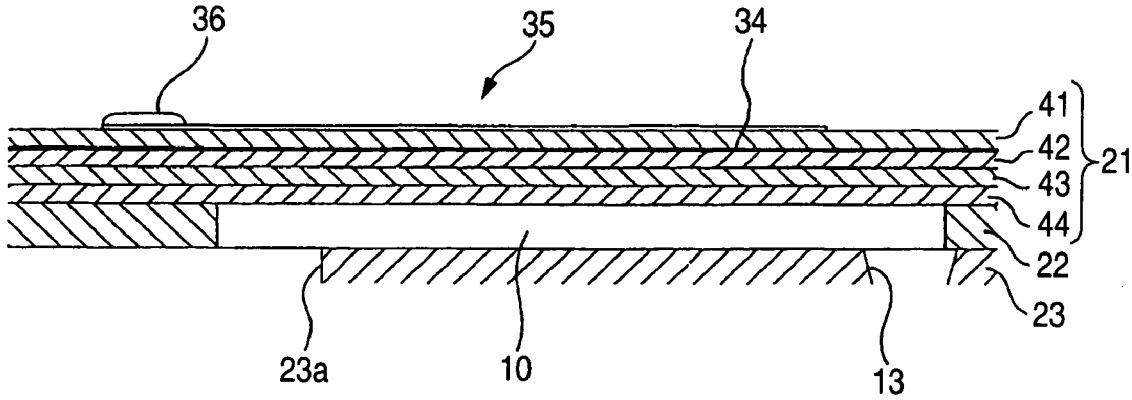
FIGS. 8A and 8B show an actuator unit, with FIG. 8A being an enlarged diagram of the part enclosed by the one-dot chain line shown in FIG. 6A, and FIG. 8B being an enlarged plan diagram showing part of an upper surface of the actuator unit.
Figure 8B:
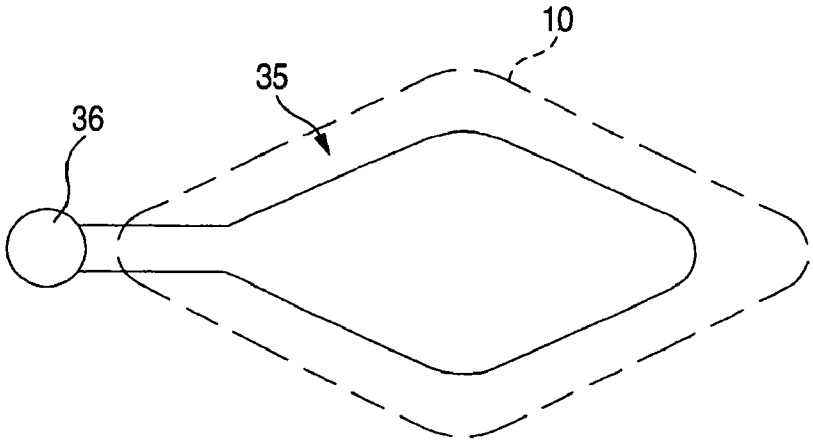

As shown in FIG. 8A, the actuator unit 21 includes four piezoelectric sheets 41 to 44, which are formed with the same thickness of about 15 μm. The piezoelectric sheets 41 to 44 form a layer-like plate (continuous plate layer) connected so as to be disposed across the numerous pressure chambers 10. Because the piezoelectric sheets 41 to 44 are disposed across the numerous pressure chambers 10 as a continuous plate layer, it becomes possible to dispose the individual electrodes 35 at a high density on the piezoelectric sheet 41 using screen printing technology, for example. For this reason, it also becomes possible to dispose, at a high density, the pressure chambers 10 formed at positions facing the individual electrodes 35, so that high-resolution image printing becomes possible. The piezoelectric sheets 41 to 44 comprise a ferroelectric ceramic material of lead zirconate titanate (PZT).

Each individual electrode 35 is formed on the uppermost piezoelectric sheet 41. A common electrode 34, which has a thickness of substantially 2 μm and is formed on the entire sheet, is disposed between the uppermost piezoelectric sheet 41 and the piezoelectric sheet 42 therebelow. Electrodes are not disposed between the piezoelectric sheet 42 and the piezoelectric sheet 43 or between the piezoelectric sheet 43 and the piezoelectric sheet 44. The individual electrodes 35 and the common electrode 34 comprise a metal material such as Ag—Pd.

Each individual electrode 35 has a thickness of substantially 1 μm and, as shown in FIG. 8B, has a substantial diamond-shape in plan view that is substantially similar to the shape of the pressure chamber 10. One of the acute angle portions of the substantially diamond-shaped individual electrode 35 is extended, and a circular land portion 36 is disposed at the end of that extension. The land portion 36 has a diameter of substantially 160 μm and is electrically connected to the individual electrode 35. The land portion 60 comprises gold including glass frit. Also, the land portion 160 is electrically bonded to a contact point disposed on the FPC 50.

The common electrode 34 is grounded at an unillustrated region. Thus, the common electrode 34 is retained in a ground state equal at the regions corresponding to all of the pressure chambers 10. Also, the individual electrodes 35 are connected to an unillustrated control unit via the land portions 36 and the FPC 50 including separate lead wires independent for each individual electrode 35 so that the potential of each individual electrode 35 can be controlled in correspondence to each pressure chamber 10.

Next, the method of driving the actuator units 21 will be described. The polarization direction of the piezoelectric sheet 41 in the actuator units 21 is the thickness direction thereof. In other words, the actuator units 21 have a so-called unimorph type configuration in which the single piezoelectric sheet 41 at the upper side (i.e., separate from the pressure chamber 10) is the layer where the active layer is present and the three piezoelectric sheets 42 to 44 at the lower side (i.e., closer to the pressure chamber 10) are the inactive layers. Thus, when the individual electrodes 35 are given a positive or negative predetermined potential, e.g., if the electric field and the polarization are in the same direction, then the electric field-applied portion in the piezoelectric sheet 41 sandwiched between the electrodes works as an active layer and shrinks in the direction of a right angle to the polarization direction due to the piezoelectric transverse effect. On the other hand, because the piezoelectric sheets 42 to 44 are not influenced by the electric field, they do not spontaneously shrink. Thus, a difference arises between the upper piezoelectric sheet 41 and the lower piezoelectric sheets 42 to 44 in the strain in the direction perpendicular to the polarization direction, and all of the piezoelectric sheets 41 to 44 are deformed so as to become convex at the inactive side (unimorph deformation). At this time, because the undersurface of the piezoelectric sheets 41 to 44 is fixed to the upper surface of the cavity plate 22 partitioning the pressure chambers 10, as shown in FIG. 8A, the piezoelectric sheets 41 to 44 are deformed so as to become convex towards the pressure chamber. For this reason, the capacity of the pressure chamber 10 drops, the pressure of the ink rises, and the ink is discharged from the nozzle 8. Thereafter, when the individual electrode 35 is returned to the same potential as the common electrode 34, the piezoelectric sheets 41 to 44 return to their former shape, and the capacity of the pressure chamber 10 returns to its former capacity. Thus, the ink is sucked in from the manifold flow path 5.

As another drive method, the individual electrodes 35 may be given, in advance, a potential that is different from that of the common electrode 34, the individual electrodes 35 may be temporarily switched to the same potential as that of the common electrode 34 each time there is a discharge request, and thereafter the individual electrodes 35 may again be given the potential that is different from that of the common electrode 34 at a predetermined timing. In this case, the piezoelectric sheets 41 to 44 are returned to their former shapes at a timing where the individual electrodes 35 and the common electrode 34 become the same potential, whereby the capacities of the pressure chambers 10 are increased in comparison to their initial state (state where the potentials of the electrodes are different), and the ink is sucked into the pressure chambers 10 from the manifold flow path 5. Thereafter, the piezoelectric sheets 41 to 44 are deformed so that they become convex towards the pressure chambers 10 at the timing where the individual electrodes 35 again become the potential that is different from that of the common electrode 34, the pressure towards the ink rises due to the drop in the capacities of the pressure chambers 10, and the ink is discharged.

If the direction of the electric field applied to the piezoelectric sheet 41 and the polarization direction are opposite, the active layer in the piezoelectric sheet 41 sandwiched between the individual electrodes 35 and the common electrode 34 tries to extend in the direction perpendicular to the polarization direction as a result of the piezoelectric transverse effect. Thus, the piezoelectric sheets 41 to 44 are deformed so that they become concave towards the pressure chambers 10. For this reason, the capacities of the pressure chambers 10 increase, and the ink is sucked in from the manifold 5. Thereafter, when the potentials of the individual electrodes 35 return to the former potentials, the piezoelectric sheets 41 to 44 become their former plan shapes and the capacities of the pressure chambers 10 return to the former capacities, whereby the ink is discharged from the nozzles 8.

As described above, the inkjet head 1 in the present embodiment is disposed with the manifold flow path 5 including the regions 14 and the plural intersecting regions 11 in which the plural sub-manifolds 5*a* and 5*b* are communicated with each other. Thus, pressure waves propagating to the manifold flow path 5 from the pressure chambers 10 successively propagate via the intersecting regions 11 and the regions 14 to the numerous sub-manifolds 5*a* and 5*b*. In other words, pressure waves propagating from the pressure chambers 10 to one sub-manifold 5*a* propagate to the other sub-manifold 5*b* communicated with that sub-manifold 5*a* at the intersecting region 11 and successively propagate to the numerous sub-manifolds 5*a* and 5*b*. Similarly, the pressure waves propagate to the other sub-manifold 5*b* communicating at the region 14 and successively propagate to the numerous sub-manifolds 5*a* and 5*b*. For this reason, the pressure waves become rapidly attenuated inside the manifold flow path 5. Thus, even if the pressure waves propagate inside the manifold flow path 5 from the pressure chambers 10, the pressure inside the manifold flow path 5 becomes substantially even in a short period of time, the pressure waves propagating through the manifold flow path 5 exert virtually no adverse affect on the discharging of the ink from the nozzles 8, and the ink discharge speeds become even. Also, because the plural sub-manifolds 5*a* and 5*b* include the intersecting regions 11 at at least two places and the regions 14, the manifold flow path 5 includes many paths that can cause the pressure waves propagating from the pressure chambers to be propagated to the other sub manifolds 5*a* and 5*b*.

Figure 9:
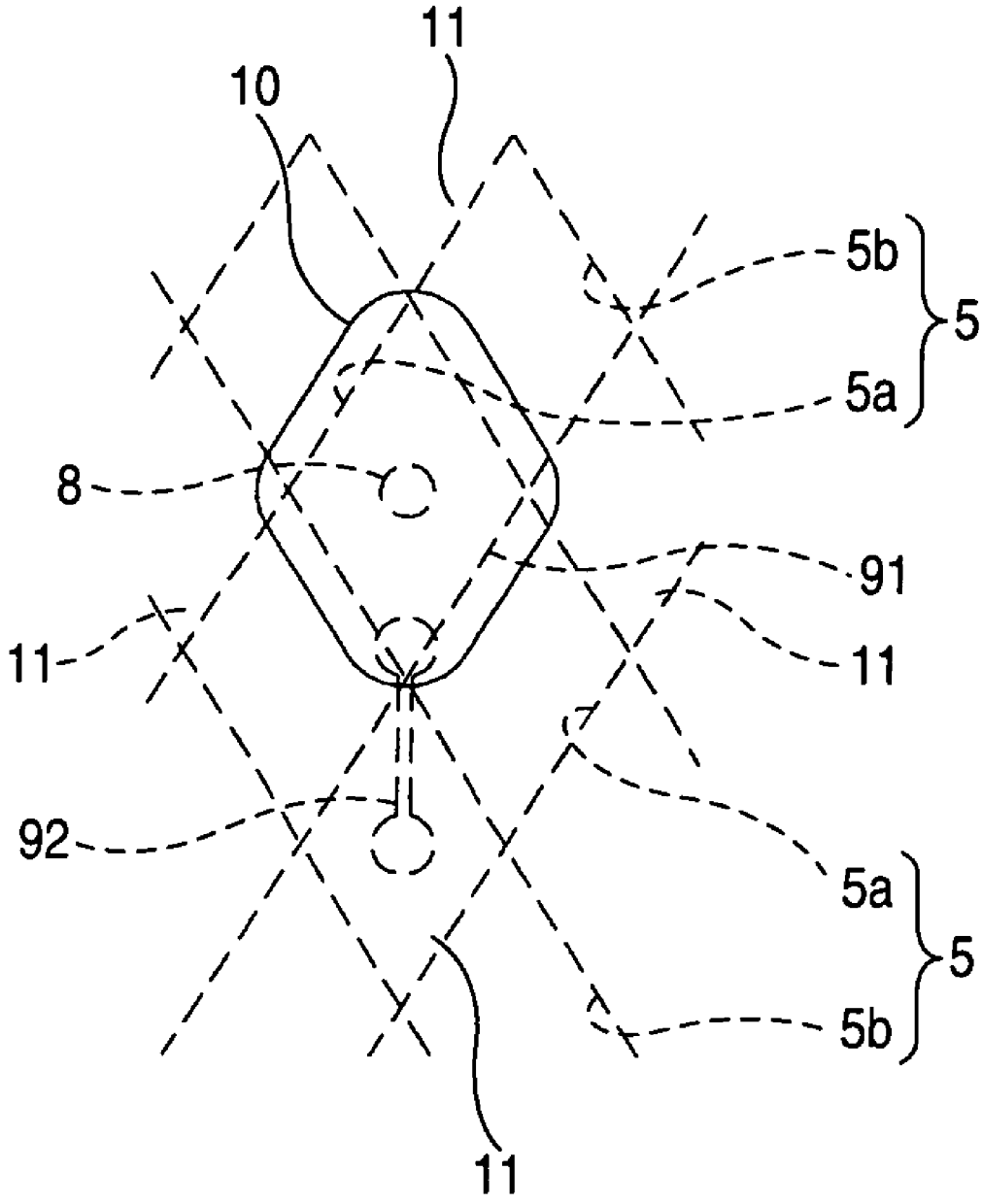
FIG. 9 is an explanatory diagram showing a modified example of the inkjet head according to the embodiment of the invention.

In the present embodiment, the pressure chambers 10 and the intersecting regions 11 were disposed so that their centers coincided, but as shown in FIG. 9, the pressure chambers 10 may also be disposed so that they overlap regions 91 surrounded by four intersecting regions 11. The regions 91 are regions where the digit portions along the sub-manifolds 5*a* and 5*b*, which are digit portions where the sub-manifolds 5*a* and 5*b* of the first and second manifold plates are not formed, intersect. The regions 91 have diamond-like shapes that are substantially the same size as the intersecting regions 11. Additionally, the centers of the pressure chambers 10 are disposed so as to coincide with the centers of the regions 91. An aperture 92 extends from a position coinciding with the center of the intersecting region 11 to a position coinciding with one acute angle portion of the pressure chamber 10, and supplies the ink to the pressure chamber 10 from the manifold flow path 5. The nozzle 8 is formed at a position coinciding with the center of the pressure chamber 10. Even in an inkjet head having this configuration, similar to the above, pressure waves propagating from the pressure chambers to the sub-manifolds 5*a* can be propagated to the other many sub-manifolds 5*a* and 5*b* via the intersecting regions 11 and the regions 14, and the pressure waves can become rapidly attenuated. Thus, even if the pressure waves propagate inside the manifold flow path 5 from the pressure chambers, the pressure inside the manifold flow path 5 becomes substantially even in a short period of time, the pressure waves propagating through the manifold flow path 5 exert virtually no adverse affect on the discharging of the ink from the nozzles 8, and the ink discharge speeds become even. Also, because the centers of the pressure chambers 10 and the regions 91 coincide, the regions 91 are present in regions facing all of the pressure chambers 10, and the positional relationships between the pressure chambers 10 and the intersecting regions 11 become the same with respect to every pressure chamber 10. For this reason, the positional relationships between the pressure chambers 10 and the manifold flow path 5 can all be made the same with respect to every pressure chamber 10. Thus, the compliances of the pressure chambers can be made uniform, and it becomes possible to make uniform the speeds at which the ink is discharged from the nozzles 8.

Appropriate modifications to the embodiment of the invention described above are possible as long as those modifications satisfy all three of the following conditions (a) to (c). Condition (a) is that the descender flow paths (communication holes 24*a* to 26*a*) and the nozzles 8 are formed in the digit regions 12; condition (b) is that the inlets of the apertures 13 coincide with the sub-manifolds 5*a* when the flow path unit 4 is seen in plan view; and condition (c) is that the relative positions of all of the pressure chambers 10 with respect to the intersecting regions 11 of the manifold flow path 5 are equal.

A preferred embodiment of the invention has been described above, but the invention is not limited to this embodiment. Various design alterations are possible within the range described in the claims. For example, the manifold flow path 5 of the inkjet head 1 may also be configured by sub-manifolds 5*a* and 5*b* formed so as to intersect in the same plane. In other words, in the embodiment described above, the height levels of the sub-manifolds 5*a* and 5*b* were different, but the sub-manifolds may also be formed at the same height level. Also, the outlets 5*c* for the ink from the manifold flow path 5 may also be disposed at positions coinciding with something other than the intersecting regions 11. Also, the manifold flow path may include at least one intersecting region formed by the sub-manifolds 5*a* and the sub-manifolds 5*b* intersecting at at least one place. Also, in the inkjet head 1 described above, the positional relationships between all of the pressure chambers 10 and the manifold flow path 5 do not have to be the same. Also, the manifold flow path may be configured as a result of the sub-manifolds intersecting at right angles. Also, the end portions of the sub-manifolds 5*a* and 5*b* do not have to coincide.

What is claimed is:

1. An inkjet head comprising:

a plurality of nozzles;

a manifold flow path filled with ink to be discharged from the nozzles;

an ink flow inlet path that supplies ink from outside through an ink supply port to the manifold flow path; and a plurality of individual ink flow paths that lead from an outlet of the manifold flow path through a pressure chamber to the nozzles, wherein the manifold flow path includes a plurality of unit flow paths, wherein both ends of each unit flow path communicates with the ink flow inlet path, wherein the unit flow paths are disposed to intersect with each other when viewed from a direction orthogonal to a predetermined plane, and wherein the unit flow paths are communicated with each other at an intersecting region.

2. The inkjet head according to claim 1, wherein a plurality of the pressure chambers are arranged along the predetermined plane, and wherein the outlet of the manifold flow path is disposed at a position coinciding with the intersecting region when viewed from the direction orthogonal to the predetermined plane.

3. The inkjet head according to claim 2, wherein the pressure chambers are disposed so that positional relationships thereof with a plurality of intersecting regions are the same when viewed from the direction orthogonal to the plane.

4. The inkjet head according to claim 3, wherein centers of the pressure chambers coincide with centers of the intersecting regions when viewed from the direction orthogonal to the plane.

5. The inkjet head according to claim 1, wherein the unit flow paths has a plurality of first unit flow paths extending in a first direction and a plurality of second unit flow paths extending in a second direction intersecting the first direction.

6. The inkjet head according to claim 5, wherein the first unit flow paths at least partially intersect the second unit flow paths at least two places when viewed from the direction orthogonal to the plane.

7. The inkjet head according to claim 5, wherein a plurality of types of plates have at least one hole that forms at least one of the ink flow inlet path, the manifold flow path and the individual ink flow paths, wherein the plates are laminated so that the hole is communicated with each other to form the at least one of the ink flow inlet path, the manifold flow path and the individual ink flow paths, and wherein the plates include a first manifold plate in which the first unit flow paths are formed and a second manifold plate in which the second unit flow paths are formed.

8. The inkjet head according to claim 7, wherein end portions of the first unit flow paths and the second unit flow paths are at least partially communicated with each other.

9. The inkjet head according to claim 7, wherein the first direction is not parallel to a longitudinal direction of the first manifold plate, and wherein the second direction is not parallel to a longitudinal direction of the second manifold plate.

10. The inkjet head according to claim 9, wherein the ink flow inlet path extends in a direction which is parallel to the longitudinal direction of the plates.

11. The inkjet head according to claim 1, wherein:

the nozzles are arranged along the predetermined plane; and each of the nozzles is formed within a region surrounded by the unit flow paths when viewed from the direction orthogonal to the predetermined plane.

12. The inkjet head according to claim 1, wherein:

a plurality of types of plates have at least one hole that forms at least one of the ink flow inlet path, the manifold flow path and the individual ink flow paths;

the plates are laminated so that the hole is communicated with each other to form the at least one of the ink flow inlet path, the manifold flow path and the individual ink flow paths;

the plates include a first outermost plate and a second outermost plate which are laminated as outermost layers of the plates;

the first outermost plate includes the nozzles; and the second outermost plate includes a plurality of the pressure chambers.

13. The inkjet head according to claim 12, further comprising:

a common electrode retained in a predetermined potential;

a plurality of individual electrodes respectively disposed to overlap the pressure chambers when viewed from the direction orthogonal to the predetermined plane along which the pressure chambers are arranged; and an actuator unit including an actuator sheet sandwiched between the common electrode and the individual electrodes, and the actuator unit that extends across the pressure chambers and adhered to the second outermost plate.

* * * * *